US009057979B2

(12) United States Patent
Kim et al.

(10) Patent No.: US 9,057,979 B2
(45) Date of Patent: Jun. 16, 2015

(54) APPARATUS FOR AND METHOD OF FORMING IMAGE

(71) Applicant: SAMSUNG ELECTRONICS CO., LTD., Suwon-si (KR)

(72) Inventors: Kyung-hwan Kim, Seongnam-si (KR); Sung-wook Kang, Seoul (KR); Yury Telegin, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 146 days.

(21) Appl. No.: 13/790,233

(22) Filed: Mar. 8, 2013

(65) Prior Publication Data

US 2014/0016968 A1 Jan. 16, 2014

(30) Foreign Application Priority Data

Jul. 11, 2012 (KR) ..... 10-2012-0075748

(51) Int. Cl.
*G03G 15/08* (2006.01)

(52) U.S. Cl.
CPC ..... *G03G 15/0803* (2013.01)

(58) Field of Classification Search
CPC ..... G03G 15/0803
USPC ..... 399/265, 266
See application file for complete search history.

(56) References Cited

U.S. PATENT DOCUMENTS 6,157,804 A * 12/2000 Richmond et al. ..... 399/319
2008/0152399 A1* 6/2008 Umeda et al. ..... 399/307

FOREIGN PATENT DOCUMENTS

JP 05333703 A * 12/1993
JP 2001-117381 4/2001
JP 2003-270949 9/2003

OTHER PUBLICATIONS

John Fuchs, Ultrasonics-Transducers-Piezoelectric Hardware, Jan. 2012, Published at (http://www.ctgclean.com/tech-blog/2012/01/ultrasonics-transducers-piezoelectric-hardware/).*
Shinozaki (JP 05-333703 A), Dec. 1993, JPO Computer Translation.*

* cited by examiner

*Primary Examiner* — David Gray
*Assistant Examiner* — Erika J Villaluna
(74) *Attorney, Agent, or Firm* — Staas & Halsey LLP

(57) ABSTRACT

An apparatus for and method of forming images. The apparatus includes a photosensitive member, a charging member configured to electrify a surface of the photosensitive member to a predetermined electric potential, an exposure member configured to form an electrostatic latent image on the electrified surface of the photosensitive member, and a developing member configured to develop a toner image on the surface of the photosensitive member on which the electrostatic latent image is formed. The developing member converts a toner disposed near the photosensitive member into a cloud state using ultrasonic oscillation and adheres the cloud-state toner to the electrostatic latent image due to a bias voltage applied between the developing member and the photosensitive member.

26 Claims, 5 Drawing Sheets

APPARATUS FOR AND METHOD OF FORMING IMAGE

CROSS-REFERENCE TO RELATED APPLICATIONS

This application claims the priority benefit of Korean Patent Application No. 10-2012-0075748, filed on Jul. 11, 2012, in the Korean Intellectual Property Office, the disclosure of which is incorporated herein in its entirety by reference.

BACKGROUND

1. Field

The present general inventive concept relates to an apparatus for and method of forming images and, more particularly, to an apparatus for and method of forming images, which may improve a developing member configured to develop a toner image.

2. Description of the Related Art

Image forming apparatuses configured to form images on a recording medium may include printers, photocopiers, fax machines, and multifunctional copiers/printers into which functions thereof are integrated. An image forming apparatus, particularly, an electrophotographic image forming apparatus, may form electrostatic latent images on a photosensitive member and develop the electrostatic latent images using a developing agent, such as a toner, to form images.

In recent years, research has been conducted into a contactless developing technique of forming high-quality images using a simple configuration. A conventional contactless developing technique includes converting a toner into a cloud state by inducing discharge due to electric energy applied to an wire electrode disposed apart from a donor roller configured to convey the toner.

However, when the toner is converted into the cloud state using the wire electrode, the density of clouds may be non-uniform due to the use of an electrode wire with a small diameter, thereby causing image failures, such as image banding and blur. Also, when the donor roller is used, part of the toner may remain on the donor roller after a developing process, thereby causing image failures, such as a ghost phenomenon. Furthermore, since the natural frequency of the electrode wire is within an audio-frequency range of 2 kHz or less, noise may occur. Also, due to long-term application of a high tension to the electrode wire, the endurance of an image forming apparatus may be degraded. For example, the electrode wire may be cut.

SUMMARY

Additional aspects and/or advantages will be set forth in part in the description which follows and, in part, will be apparent from the description, or may be learned by practice of the invention.

The present general inventive concept provides an apparatus for and method of forming images using a new technique, which may use an element configured to transduce electric energy into mechanical energy and convert a toner into a cloud state to develop images.

According to an aspect of the present general inventive concept, there is provided an image forming apparatus including a photosensitive member, a charging member configured to electrify a surface of the photosensitive member to a predetermined electric potential, an exposure member configured to form an electrostatic latent image on the electrified surface of the photosensitive member, and a developing member configured to develop a toner image on the surface of the photosensitive member on which the electrostatic latent image is formed, wherein the developing member converts a toner disposed near the photosensitive member into a cloud state using ultrasonic oscillation and adheres the cloud-state toner to the electrostatic latent image due to a bias voltage applied between the developing member and the photosensitive member.

The developing member may include a plate disposed opposite the photosensitive member, the plate on which the toner is loaded, and a transduction element connected to the plate and configured to transduce electrical energy into mechanical energy and oscillate the toner loaded on the plate to convert the toner into a cloud state.

The transduction element may be an ultrasonic transducer having an oscillation frequency of about 15 kHz to about 60 kHz.

The transduction element may be a Langevin-type ultrasonic transducer. The transduction element may include a piezoelectric element, an electrode connected to the piezoelectric element, and oscillation blocks disposed on both top and bottom ends of the piezoelectric element.

A plurality of piezoelectric elements may be provided such that polarization directions of the plurality of piezoelectric elements face one another.

The transduction element may further include a horn configured to amplify oscillation of the piezoelectric element in a thickness direction. The horn may have an exponential sectional shape.

The plate and the transduction element may be fixedly connected by at least one of a bolt connection technique and an adhesive connection technique.

A V-shaped groove may be formed in a top surface of a region of the plate connected to the transduction element.

The plate may be inclined downward along a direction in which the toner is conveyed. The plate may be inclined at an angle of about 50° or less with respect to a direction perpendicular to a direction of gravity.

A top surface of the plate may have a roughness of 10 μm or less.

The plate may include at least one selected from the group consisting of duralumin, titanium (Ti), aluminum (Al), bronze, stainless steel (SUS), and carbon (C) steel.

A plurality of transduction elements may be provided apart from one another in a direction perpendicular to a direction in which the toner is conveyed. The plurality of transduction elements may be symmetrically disposed with respect to a central line of the plate.

The image forming apparatus may further include a controller connected to the plurality of transduction elements.

According to another aspect of the present general inventive concept, there is provided a method of forming images, including: electrifying a surface of a photosensitive member to a predetermined electric potential, forming an electrostatic latent image on the surface of the photosensitive member, converting a toner disposed near the photosensitive member into a cloud state using ultrasonic oscillation applied by a developing member, and adhering the cloud-state toner to the electrostatic latent image due to a bias voltage applied between the developing member and the photosensitive member.

The conversion of the toner disposed near the photosensitive member into the cloud state may include loading the toner on a plate disposed opposite the photosensitive member, and transducing electric energy into mechanical energy using a transduction element connected to the plate to oscillate the toner loaded on the plate and convert the toner into the cloud state.

The transduction element may be an ultrasonic transducer having an oscillation frequency of about 15 kHz to about 60 kHz.

The transduction element may be a Langevin-type ultrasonic transducer.

A plurality of transduction elements may be provided apart from one another in a direction perpendicular to a direction in which the toner is conveyed.

The plurality of transduction elements may be symmetrically disposed with respect to a central line of the plate.

The plurality of transduction elements may be controlled by a single controller.

According to an apparatus for and method of forming images according to the present general inventive concept, a large amount of toner loaded on a plate can be converted into a cloud state using ultrasonic oscillation. Thus, not only an imaging speed but also image quality can be improved. Also, since ultrasonic oscillation is used, the endurance of the image forming apparatus can increase, and generation of noise can be prevented.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION

An apparatus for and method of forming images according to the present general inventive concept will now be described more fully with reference to the accompanying drawings, in which exemplary embodiments of the present general inventive concept are shown. As used herein, expressions such as "at least one of," when preceding a list of elements, modify the entire list of elements and do not modify the individual elements of the list.

Figure 1:
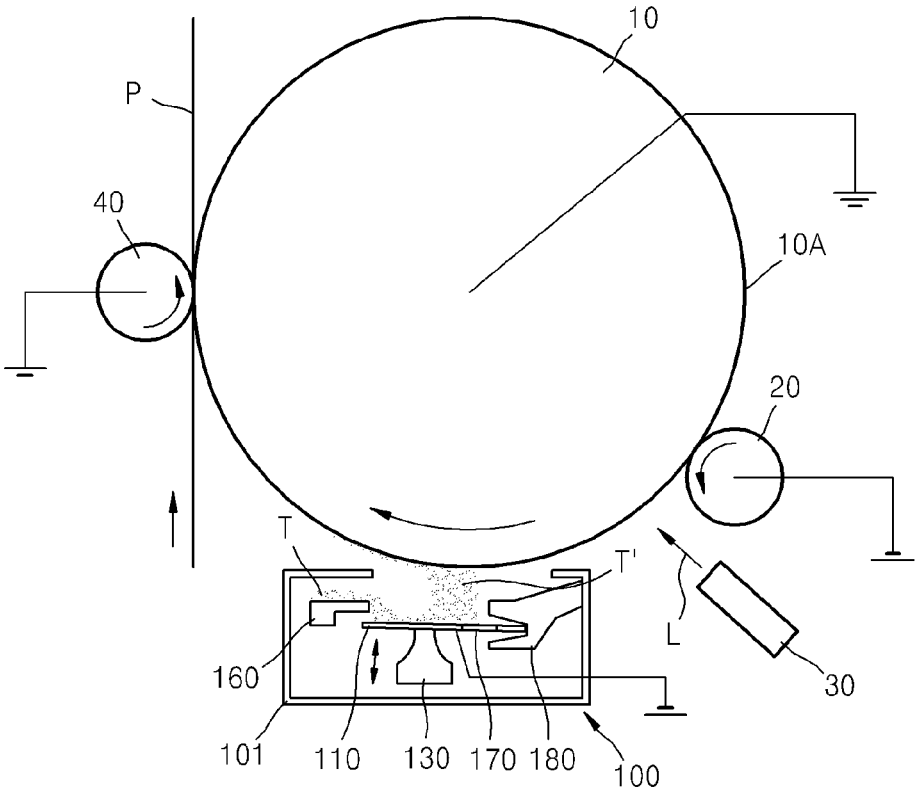
FIG. 1 is a schematic construction diagram of an image forming apparatus according to an embodiment of the present general inventive concept.

FIG. 1 is a schematic construction diagram of an image forming apparatus according to an embodiment of the present general inventive concept. Referring to FIG. 1, the image forming apparatus may include a photosensitive member 10, a charging member 20, an exposure member 30, and a developing member 100.

Before describing specific features of the present general inventive concept, a process of forming an image on a recording medium will briefly be explained.

To form a desired image on a recording medium P, an image forming apparatus forms an electrostatic latent image corresponding to the desired image on a surface 10A of the photosensitive member 10 and adhere a cloud-state toner T' (hereinafter, referred to as a 'toner cloud') to the electrostatic latent image to form a toner image corresponding to the electrostatic latent image.

To form the electrostatic latent image, the surface 10A of the photosensitive member 10 may be electrified to a predetermined electric potential by the charging member 20. A predetermined charging bias voltage of, for example, about −700V to about −800V, may be applied to the charging member 20. A charging roller or a corona charger may be adopted as the charging member 20. In this case, a different voltage from the voltage applied to the surface 10A, for example, a ground voltage GND of 0V, may be applied to the photosensitive member 10.

Modulated light L corresponding to image information may be irradiated by the exposure member 30 to the electrified surface 10A of the photosensitive member 10. A region of the surface 10A of the photosensitive member 10 to which the light L is irradiated may have a varied surface potential. For example, when the surface 10A of the photosensitive member 10 is electrified to a potential of about −700V to −800V, a surface potential of the region irradiated with the light L may be reduced to about −50V to about −100V. By varying the surface potential of the region irradiated with the light L, an electrostatic latent image may be formed. In this case, the exposure member 30 may be a light-emitting diode (LED)-type exposure unit capable of selectively allowing a plurality of LEDs arranged in a main scan direction to emit light. Alternatively, the exposure member 30 may be a laser scanning unit (LSU) capable of deflecting light irradiated by a laser diode (LD) in the main scan direction using a light deflector, and scanning the deflected light to the surface 10A of the photosensitive member 10.

The developing member 100 may supply a toner cloud T to the surface 10A of the photosensitive member 10 on which the electrostatic latent image is formed, and develop a toner image corresponding to image information.

The present embodiment pertains to a contactless technique in which the toner T is conveyed by conveying unit 160 is converted into the cloud state and the toner cloud T' is supplied to the surface 10A of the photosensitive member 10 to form a highly uniform image.

Here, by applying a bias voltage between the developing member 100 and the photosensitive member 10, the toner cloud T' may move to the surface 10A of the photosensitive member 10. In this case, although not shown, the toner T may remain charged with substantially the same polarity as the surface 10A of the photosensitive member 10, for example, negative (−) polarity. Similarly, the toner cloud T' obtained by converting the toner T into the cloud state may remain charged with substantially the same polarity as the surface 10A of the photosensitive member 10. Thus, the toner cloud T' may be adhered to the electrostatic latent image, which is a region having a different surface potential from the surface 10A of the photosensitive member 10, to form a toner image.

The toner image may be adhered to one surface of the recording medium P supplied between the photosensitive member 10 and a transfer member 40. In this case, a predetermined bias voltage having an opposite polarity to the toner image may be applied to the transfer member 40. Although FIG. 1 pertains to an example in which the photosensitive member 10 is in direct contact with the recording medium P, the present general inventive concept is not limited thereto, and an intermediate transfer belt (ITB) may be disposed between the photosensitive member 10 and the transfer member 40.

Although not shown, the image forming apparatus may include a paper supply unit (not shown) configured to supply the recording medium P, a fusing unit (not shown) configured to fuse the toner image adhered to the recording medium P, and a paper discharge unit (not shown) configured to discharge the fused recording medium P.

Figure 2:
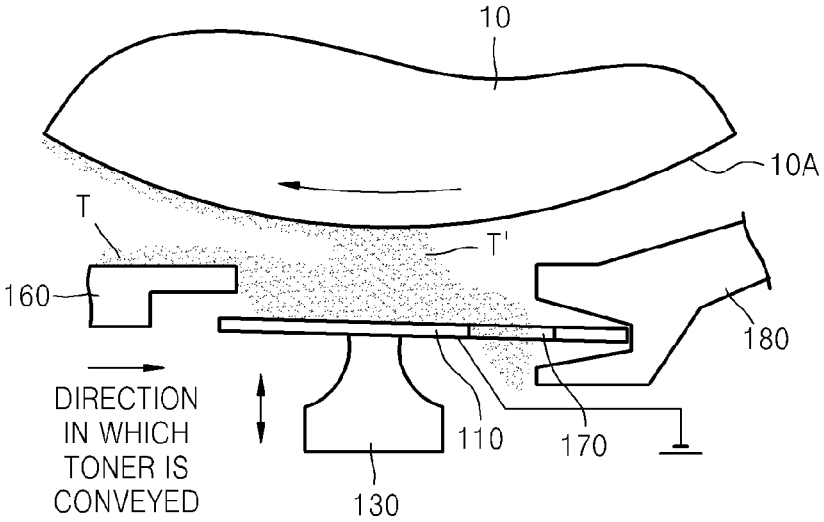
FIG. 2 is an enlarged view of a developing member of the image forming apparatus of FIG. 1, according to an embodiment of the present general inventive concept.

FIG. 2 is an enlarged view of the developing member 100 of the image forming apparatus of FIG. 1, according to an embodiment of the present general inventive concept.

Referring to FIGS. 1 and 2, the developing member 100 according to the present embodiment may use ultrasonic oscillation to convert the toner T into a cloud state. Specifically, a technique of converting the toner T into the cloud state using ultrasonic oscillation may include converting the toner T into the cloud state using oscillation caused by transducing electric energy into mechanical energy. Since this technique is absolutely different from a conventional technique of converting a toner into a cloud state using discharge and does not require a donor roller, image failures (e.g., ghost) caused by the use of the donor roller may be prevented. Also, since an oscillation frequency belonging to an ultrasonic region is used, noise may be eliminated.

To employ ultrasonic oscillation, the developing member 100 may include a housing 101, a transduction element 130 configured to transduce electric energy into mechanical energy and a plate 110 connected to the transduction element 130 and capable of loading the toner T.

The transduction element 130 may receive alternating-current (AC) power from an external power supply and cause oscillation, which is repetition of mechanical movements (i.e., compression and expansion). The oscillation may be transmitted to the plate 110 connected to the transduction element 130. Due to the plate 110 that oscillates along with the transduction element 130, the toner T loaded on the plate 110 may be converted into the cloud state.

The transduction element 130 serving as an ultrasonic oscillator may have an oscillation frequency of about 15 kHz to about 60 kHz. Since most of the oscillation frequency of the transduction element 130 departs from an audio frequency, generation of noise may be reduced as compared with the conventional case in which a toner is converted into a cloud state using discharge.

Figure 3A:
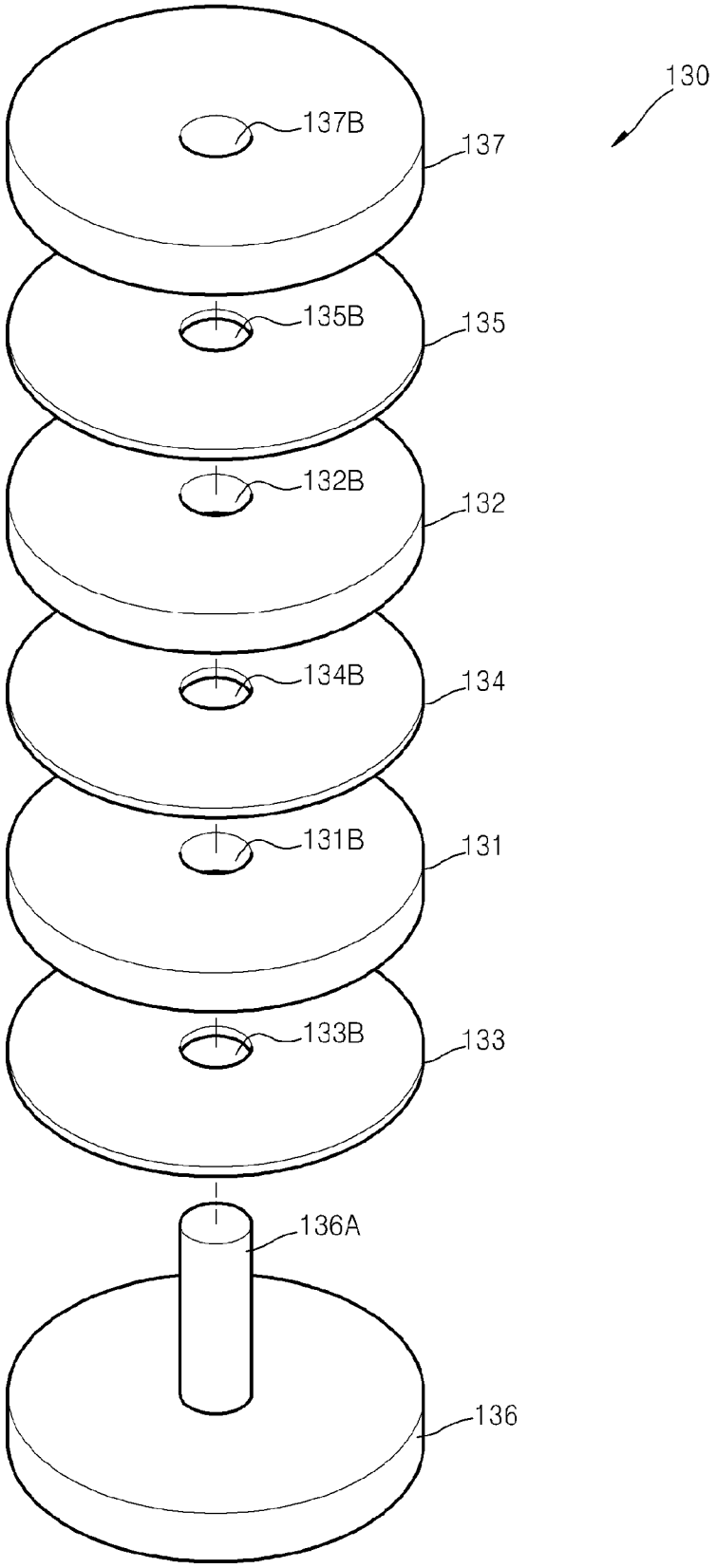
FIG. 3A is a schematic exploded perspective view of a transduction element of the developing member of FIG. 2.
Figure 3B:
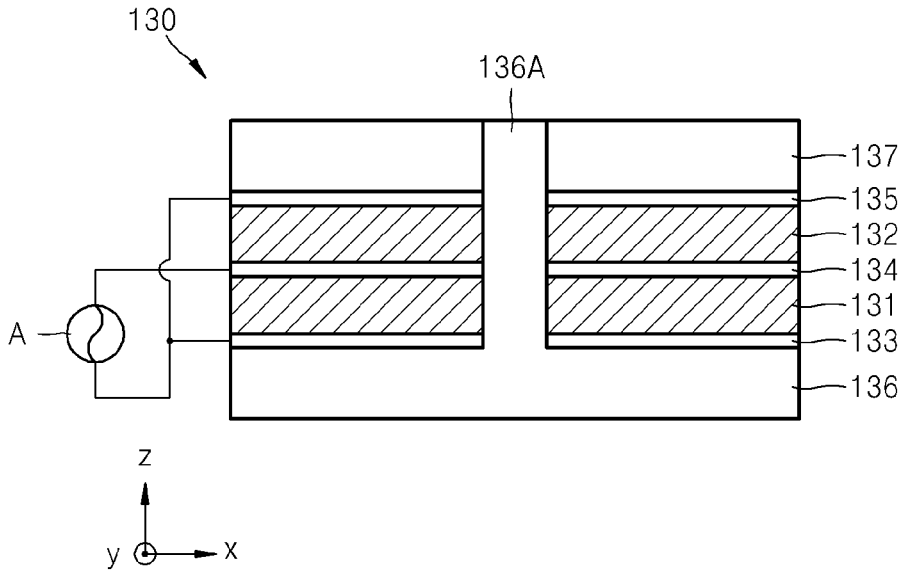
FIG. 3B is a schematic cross-sectional view of the transduction element of the developing member of FIG. 2.

FIG. 3A is a schematic exploded perspective view of the transduction element 130 of the developing member of FIG. 2, and FIG. 3B is a schematic cross-sectional view of the transduction element of the developing member of FIG. 2.

A Langevin-type ultrasonic transducer may be used as the transduction element 130. The Langevin-type ultrasonic transducer may protect piezoelectric elements 131 and 132, which are vulnerable to strain, and obtain more stable outputs.

As shown in FIGS. 3A and 3B, the transduction element 130 may include the piezoelectric elements 131 and 132, electrodes 133, 134, and 135 connected to the piezoelectric elements 131 and 132, and oscillation blocks 136 and 137 disposed on both top and bottom ends of the piezoelectric elements 131 and 132. The piezoelectric elements 131 and 132, the electrodes 133, 134, and 135, and the oscillation blocks 136 and 137 may be fixed by a bolt 136A. The piezoelectric elements 131 and 132, the electrodes 133, 134, and 135, and the oscillation blocks 136 and 137 may have holes 131B-136B, respectively, which corresponds to the shape of a bolt 136A. However, the oscillation block 137 may not have a hole only one side portion thereof to be fixed with the bolt 136A. Here, although FIGS. 3A and 3B show an example in which the bolt 136A is integrally formed with the oscillation block 136, the bolt 136A may be a separate member from the oscillation block 136.

The piezoelectric elements 131 and 132 connected to the electrodes 133, 134, and 135 may convert electric signals into oscillation. Resonance frequencies of the piezoelectric elements 131 and 132 may linearly increase by force for compressing the piezoelectric elements 131 and 132 in a thickness direction. Also, as a voltage applied to the piezoelectric elements 131 and 132 increases, the amplitude of the piezoelectric elements 131 and 132 may linearly increase.

A plurality of piezoelectric elements 131 and 132 may be provided. When the plurality of piezoelectric elements 131 and 132 are connected, each of pairs of piezoelectric elements 131 and 132 may be disposed such that polarization directions thereof face each other. When the polarization directions of each of the pairs of piezoelectric elements 131 and 132 face each other, as shown in FIG. 3B, the same electrode 134 may be connected to a bottom surface of the piezoelectric element 132 disposed above and a top surface of the piezoelectric element 131 disposed below. Thus, the oscillations of the plurality of piezoelectric elements 131 and 132 may be prevented from counterbalancing one another using a relatively simple structure. Here, the electrodes 133, 134, and 135 may be formed of phosphor bronze or beryllium (Be).

The oscillation blocks 136 and 137 may include a first oscillation block 137 disposed on the top end of the piezoelectric element 132 and a second oscillation block 136 disposed on the bottom end of the piezoelectric element 131.

The first oscillation block 137 may function to amplify the amplitude of oscillation, which is caused by the piezoelectric elements 131 and 132 in the thickness direction. The second oscillation block 136 may function to reflect a downward wavelength of oscillation caused in upward and downward directions of the piezoelectric elements 131 and 132 and add the reflected wavelength to upward wavelength. To this end, the second oscillation block 136 may have a lower acoustic impedance than the piezoelectric elements 131 and 132. Also, the second oscillation block 136 may function to absorb and cool off heat generated by the transduction element 130.

A length of the transduction element 130 may be set to about a half of an oscillation wavelength of the transduction element 130 or about equal to the oscillation wavelength thereof. Thus, breakage of the transduction element 130 may be prevented while setting the amplitude to a great value.

By adopting the Langevin-type ultrasonic transducer as the transduction element 130, a natural oscillation frequency higher than the natural oscillation frequencies of the piezoelectric elements 131 and 132 may be embodied.

Figure 4A:
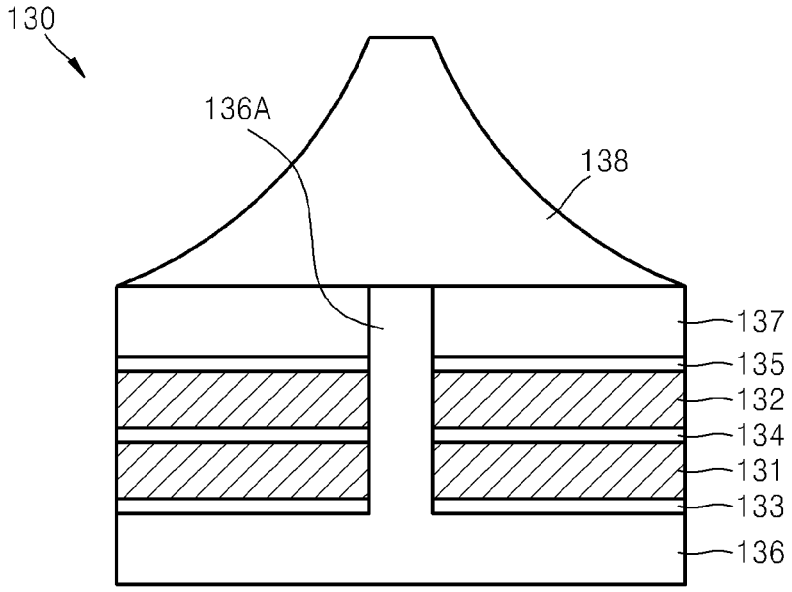
FIGS. 4A and 4B are cross-sectional views of other examples of the transduction element of the image forming apparatus according to the present embodiment.

FIG. 4A is a cross-sectional view of another example of the transduction element 130 of the image forming apparatus according to the present embodiment. Referring to FIG. 4A, the transduction element 130 may further include a horn 138 to amplify the oscillation of the piezoelectric elements 131 and 132 in a thickness direction. The horn 138 may amplify the oscillation of the piezoelectric elements 131 and 132 to satisfy an amplitude of about several hundred μm to several mm without affecting the oscillation frequency of the transduction element 130.

The horn 138 may be connected to the first oscillation block 137. The horn 138 connected to the first oscillation block 137 may concentrate oscillation received through the first oscillation block 137 on an end portion of the horn 138 having a small area, and amplify the oscillation of the piezoelectric elements 131 and 132.

Figure 4B:
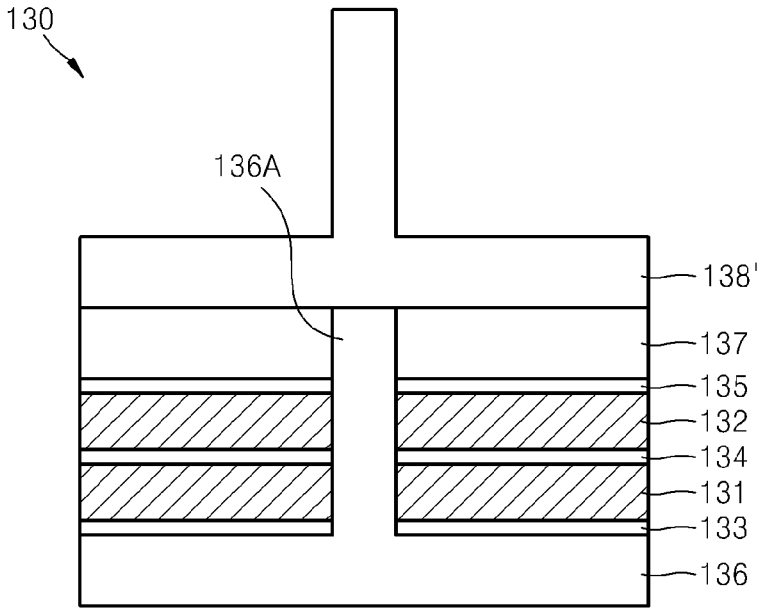

The horn 138 may be formed in various shapes in consideration of a disposition space or adjustment of oscillation power. For example, the horn 138 may be an exponential horn whose sectional shape varies exponentially as shown in FIG. 4A. Since a ratio of an oscillation speed of a top end of the exponential horn to an oscillation speed of a bottom end thereof is equal to a ratio of a diameter of the top end of the exponential horn to a diameter of the bottom end thereof, a desired oscillation speed may be embodied by controlling the diameter ratio. In another example, the horn 138 may be replaced by a stepped horn 138' as shown in FIG. 4B or a hybrid horn.

Referring back to FIG. 2, the plate 110 may be disposed opposite the photosensitive member 10, and the toner T may be loaded on the plate 110. The plate 110 may be connected to the foregoing transduction element 130, for example, to a top end portion of the transduction element 130. Thus, the plate 110 connected to the transduction element 130 may convert the toner T, which is disposed near the photosensitive member 10 disposed on the plate 110, into a cloud state due to oscillation received by the transduction element 130.

By fixedly connecting the plate 110 with the transduction element 130, oscillation of the transduction element 130 may be stably transmitted to the plate 110, and noise caused by collision of the plate 110 with the transduction element 130 may be prevented. The plate 110 and the transduction element 130 may be fixedly connected using at least one of a bolt connection technique and an adhesive connection technique. In an example of the adhesive connection technique, an adhesion method using epoxy resin may be employed.

Figure 5:
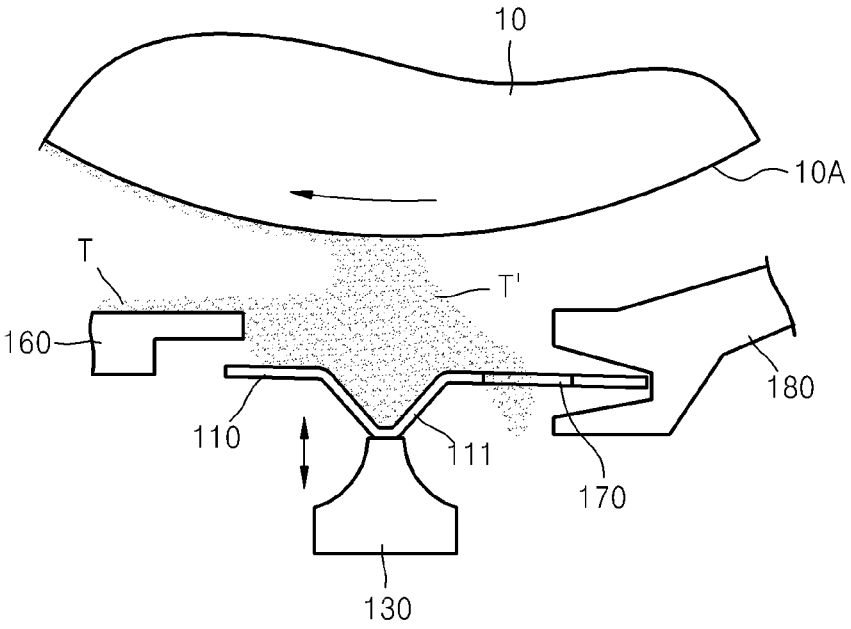
FIG. 5 illustrates a plate of the image forming apparatus according to the present embodiment.

To ensure a sufficient amount of toner cloud T', a V-shaped groove 111 formed in a top portion of the plate 110, which is connected to the transduction element 130 as shown in FIG. 5. Thus, a Neumann effect may be used. The Neumann effect refers to the focusing of oscillation received by the transduction element 130 in one direction to maximize the oscillation.

The plate 110 may convert the toner T into a cloud state and return the remaining toner T, except for the toner cloud T', to an exhaust unit 170. The exhaust unit 170 may be formed in the plate 110 or formed between the plate 110 and a support unit 180 configured to support the plate 110. To return the remaining toner T, except for the toner cloud T', to the exhaust unit 170, the plate 110 may be inclined downward along a direction in which the toner T is conveyed. For example, the plate 110 may be disposed such that an upstream side of the direction in which the toner T is conveyed is lower than a downstream side thereof. By inclining the plate 110 downward, gravity may act on the toner T loaded on the plate 110 so that the toner T can be easily retrieved. For instance, the plate 110 may be inclined at an angle of about 50° or less with respect to a horizontal direction perpendicular to the direction of gravity.

In addition, to reduce a load of the toner T caused by a relationship between the toner T and the plate 110 during the conveyance of the toner T loaded on the plate 110, a surface of the plate 110 may include a mirror surface. In an example, the plate 110 may have a surface roughness of about 10 μm or less.

A width of the plate 110 may be greater than a maximum width of the recording medium P used for the image forming apparatus. For instance, when the recording medium P has a maximum width of about A3 (297 mm), the width of the plate 110 may exceed about 297 mm.

The plate 110 may be formed of at least one material selected from the group consisting of duralumin, titanium (Ti), aluminum (Al), brass, stainless steel (SUS), and carbon (C) steel.

Furthermore, the plate 110 may be electrified to a predetermined electric potential. For example, the plate 110 may be electrified to about −200V to about −400V. In this case, when a ground voltage of 0V is applied to the photosensitive member 10, a bias voltage may be formed between the plate 110 and the photosensitive member 10 and induce the toner cloud T' to move to the surface 10A of the photosensitive member 10. Also, since the plate 110 has the same polarity as the toner T loaded on the plate 100, adhesion of the toner T to the surface of the plate 110 may be prevented.

Meanwhile, the number of transduction elements 130 fixedly connected to the plate 110 may vary according to the shape and size of the plate 110. In an example, a plurality of transduction elements 130 may be fixedly connected to the plate 110. The plurality of transduction elements 130 fixedly connected to the plate 110 may transduce the toner T loaded on the plate 110 into a toner cloud T' having a uniform density.

Figure 6:
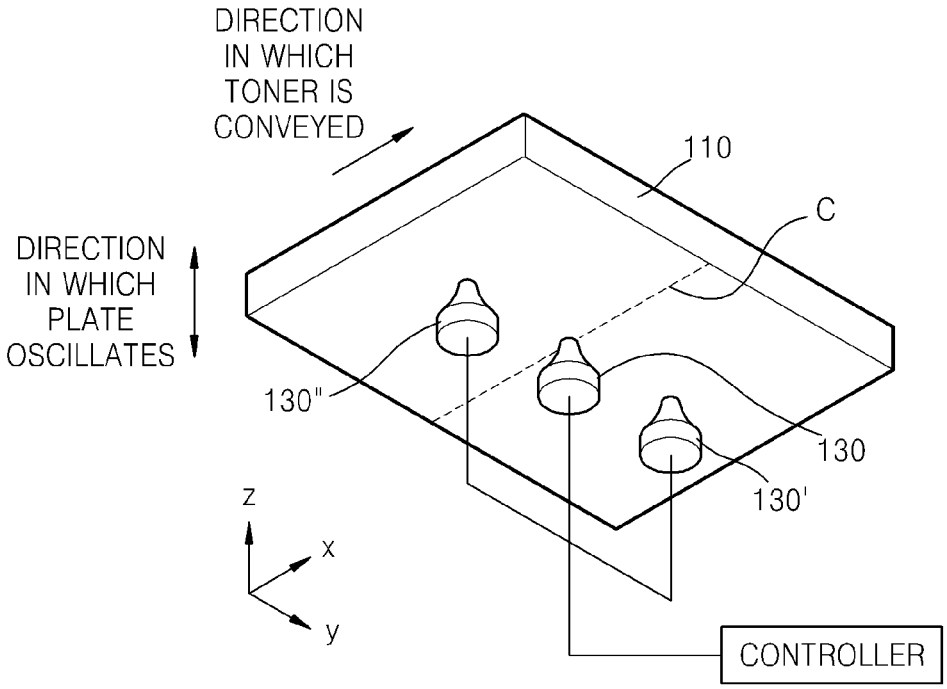
FIG. 6 illustrates arrangement of a plurality of transduction elements of the image forming apparatus according to the present embodiment.

FIG. 6 is a perspective view of arrangement of a plurality of transduction elements of the image forming apparatus according to the present embodiment, which is a bottom view of the plate 110. As shown in FIG. 6, a plurality of transduction elements 130, 130', and 130" may be disposed apart from one another in a direction (Y direction) perpendicular to a direction (X direction) in which the toner T is conveyed. The plurality of transduction elements 130, 130', and 130" may be symmetrically disposed with respect to a central line C of the plate 110. Here, the central line C refers to a line connecting the centers of lengths of the plate 110 measured in the direction (Y direction) perpendicular to the direction (X direction) in which the toner T is conveyed.

The plurality of transduction elements 130, 130', and 130" may be controlled by at least one controller. As a non-limiting example, When a single controller is used to control the plurality of transduction elements 130, 130' and 130", since oscillation phases of the plurality of transduction elements 130, 130', and 130" may be synchronized by the single controller, the oscillations of the plurality of transduction elements 130, 130', and 130" may be prevented from counterbalancing one another.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims. For example, the above-described embodiment pertains to an image forming apparatus using a monochromatic toner, but the present general inventive concept is not limited thereto. The present general inventive concept also may be applied to an image forming apparatus for forming colored images using color toners such as a cyan (C) toner, a magenta (M) toner, a yellow (Y) toner, and a blank (K) toner.

What is claimed is:

1. An image forming apparatus comprising:

a photosensitive member;

a charging member configured to electrify a surface of the photosensitive member to a predetermined electric potential;

an exposure member configured to form an electrostatic latent image on the electrified surface of the photosensitive member; and a developing member configured to develop a toner image on the surface of the photosensitive member on which the electrostatic latent image is formed;

wherein the developing member converts a toner disposed near the photosensitive member into a cloud state using ultrasonic oscillation and adheres the cloud-state toner to the electrostatic latent image due to a bias voltage applied between the developing member and the photosensitive member, wherein the developing member includes a plate disposed opposite the photosensitive member, to which plate the toner is conveyed; and a plurality of transduction elements connected to the plate and configured to transduce electrical energy into mechanical energy and oscillate the toner on the plate to convert the toner into the cloud state, wherein the plurality of transduction elements are provided apart from one another in a direction perpendicular to a direction in which the toner is conveyed.

2. The apparatus of claim 1, wherein at least one of the plurality of transduction elements is an ultrasonic transducer having an oscillation frequency of about 15 kHz to about 60 kHz.

3. The apparatus of claim 2, wherein at least one of the plurality of transduction elements are a Langevin-type ultrasonic transducer.

4. The apparatus of claim 3, wherein at least one of the plurality of transduction elements comprise:

a piezoelectric element with top and bottom ends;

an electrode connected to the piezoelectric element; and an oscillation block disposed on both of the top and bottom ends of the piezoelectric element.

5. The apparatus of claim 4, wherein the piezoelectric element comprises a plurality of piezoelectric elements provided such that polarization directions of the plurality of piezoelectric elements face one another.

6. The apparatus of claim 4, wherein at least one of the plurality of transduction elements further comprises a horn configured to amplify the oscillation of the piezoelectric element in a thickness direction.

7. The apparatus of claim 6, wherein the horn has an exponential sectional shape.

8. The apparatus of claim 7, further comprising a controller connected to the piezoelectric element, wherein the controller controls the oscillation by controlling a diameter ratio of top and bottom ends of the exponential horn.

9. The apparatus of claim 8, wherein a ratio of the oscillation of the top end of the exponential horn to the oscillation of the bottom end of the exponential horn is equal to a ratio of a diameter of the top end of the exponential horn to a diameter of the bottom end of the exponential horn.

10. The apparatus of claim 4, wherein the electrode is formed of phosphor bronze or beryllium (BE).

11. The apparatus of claim 1, wherein the plate and the plurality of transduction elements are fixedly connected by at least one of a bolt and an adhesive.

12. The apparatus of claim 1, wherein the plate is inclined downward along a direction in which the toner is conveyed.

13. The apparatus of claim 12, wherein the plate is inclined at an angle of about 50° or less with respect to a direction perpendicular to a direction of gravity.

14. The apparatus of claim 1, wherein a top surface of the plate has a roughness of 10μm or less.

15. The apparatus of claim 1, wherein the plate includes at least one selected from the group consisting of duralumin, titanium (Ti), aluminum (Al), bronze, stainless steel (SUS), and carbon (C) steel.

16. The apparatus of claim 1, wherein the plurality of transduction elements are symmetrically disposed with respect to a central line of the plate.

17. The apparatus of claim 1, further comprising a controller connected to the plurality of transduction elements.

18. The apparatus of claim 1, wherein a length of the plurality of transduction elements is about a half of an oscillation wavelength of the plurality of transduction elements.

19. The apparatus of claim 1, wherein a length of the plurality of transduction elements is about equal to an oscillation wavelength of the plurality of transduction elements.

20. The apparatus of claim 1, wherein the plate is electrified to a predetermined potential to form the bias voltage between the plate and the photosensitive member to induce the toner in the cloud state to move towards the photosensitive member when a ground voltage is applied to the photosensitive member.

21. An image forming apparatus comprising:

a photosensitive member;

a charging member configured to electrify a surface of the photosensitive member to a predetermined electric potential;

an exposure member configured to form an electrostatic latent image on the electrified surface of the photosensitive member; and a developing member configured to develop a toner image on the surface of the photosensitive member on which the electrostatic latent image is formed, wherein the developing member converts a toner disposed near the photosensitive member into a cloud state using ultrasonic oscillation and adheres the cloud-state toner to the electrostatic latent image due to a bias voltage applied between the developing member and the photosensitive member, wherein the developing member includes a plate disposed opposite the photosensitive member, on which plate the toner is loaded; and a transduction element connected to the plate and configured to transduce electrical energy into mechanical energy and oscillate the toner on the plate to convert the toner into the cloud state, wherein a V-shaped groove is formed in a top surface of a region of the plate connected to the transduction element.

22. A method of forming images, comprising:

electrifying a surface of a photosensitive member to a predetermined electric potential;

forming an electrostatic latent image on the surface of the photosensitive member;

converting a toner disposed near the photosensitive member into a cloud state using ultrasonic oscillation applied by a developing member; and adhering the cloud-state toner to the electrostatic latent image due to a bias voltage applied between the developing member and the photosensitive member, wherein the converting the toner includes conveying the toner to a plate disposed opposite the photosensitive member, and transducing electric energy into mechanical energy using a plurality of transduction elements connected to the plate to oscillate the toner on the plate and convert the toner into the cloud state, and wherein the plurality of transduction elements are provided apart from one another in a direction perpendicular to a direction in which the toner is conveyed.

23. The method of claim 22, wherein at least one of the plurality of transduction elements is selected to be an ultrasonic transducer having an oscillation frequency of about 15 kHz to about 60 kHz.

24. The method of claim 23, wherein at least one of the plurality of transduction elements is selected to be a Langevin-type ultrasonic transducer.

25. The method of claim 22, wherein the plurality of transduction elements are symmetrically disposed with respect to a central line of the plate.

26. The method of claim 25, wherein the plurality of transduction elements are controlled by a single controller.

* * * * *

UNITED STATES PATENT AND TRADEMARK OFFICE

CERTIFICATE OF CORRECTION

PATENT NO. : 9,057,979 B2
APPLICATION NO. : 13/790233
DATED : June 16, 2015
INVENTOR(S) : Kyung-hwan Kim et al.

It is certified that error appears in the above-identified patent and that said Letters Patent is hereby corrected as shown below:

In the Claims

Col. 9, line 63, claim 14, delete "10μm" and insert --10 μm-- therefor.

Signed and Sealed this
Thirteenth Day of October, 2015

Michelle K. Lee

Michelle K. Lee
*Director of the United States Patent and Trademark Office*